US007828547B2

(12) United States Patent
Gelbart

(10) Patent No.: US 7,828,547 B2
(45) Date of Patent: Nov. 9, 2010

(54) METHOD AND APPARATUS FOR RAPIDLY HEATING PRINTING PLATES

(75) Inventor: Daniel Gelbart, Vancouver (CA)

(73) Assignee: Kodak Graphic Communications, Burnaby, British Columbia (CA)

( * ) Notice: Subject to any disclaimer, the term of this patent is extended or adjusted under 35 U.S.C. 154(b) by 1209 days.

(21) Appl. No.: 11/293,571

(22) Filed: Dec. 2, 2005

(65) Prior Publication Data

US 2006/0124010 A1 Jun. 15, 2006

Related U.S. Application Data

(60) Provisional application No. 60/634,748, filed on Dec. 10, 2004.

(51) Int. Cl.
*F27B 9/14* (2006.01)
*F27B 9/28* (2006.01)

(52) U.S. Cl. ..... 432/8; 432/121; 34/643; 264/320

(58) Field of Classification Search ..... 432/8, 432/59, 121; 264/319, 320, 323; 34/643, 34/644; 430/270.1, 300; 101/415.1
See application file for complete search history.

(56) References Cited

U.S. PATENT DOCUMENTS 3,668,788 A * 6/1972 Kobayashi ..... 34/643
3,806,575 A * 4/1974 Fishburn ..... 264/219
3,902,041 A * 8/1975 May ..... 219/216
4,467,537 A * 8/1984 Trotscher ..... 34/635
4,842,664 A * 6/1989 Baudin ..... 156/102
4,981,433 A * 1/1991 Matsumoto et al. ..... 432/59
5,181,329 A 1/1993 Devaney, Jr. et al.
5,239,327 A * 8/1993 Frank ..... 396/617
5,507,102 A * 4/1996 De Vroome et al. ..... 34/62
6,001,303 A * 12/1999 Haynes et al. ..... 264/555
6,091,055 A * 7/2000 Naka et al. ..... 219/388
6,099,782 A * 8/2000 Holmes ..... 264/266
6,293,031 B1 * 9/2001 Ringbom et al. ..... 34/422
6,323,462 B1 11/2001 Strand
6,600,137 B1 * 7/2003 Nonomura et al. ..... 219/388
6,855,206 B2 * 2/2005 Minato ..... 118/663
7,278,351 B2 * 10/2007 Sugiyama et al. ..... 101/128.4
7,363,856 B1 * 4/2008 Moulin ..... 101/467

FOREIGN PATENT DOCUMENTS

EP 864 944 A1 9/1998

* cited by examiner

*Primary Examiner*—Gregory A Wilson
(74) *Attorney, Agent, or Firm*—J. Lanny Tucker

(57) ABSTRACT

Rapid heating of a lithographic printing plate is achieved by feeding the printing plate along a substantially curved path that is adjacent to one or more curved pads of an air bearing that is pressurized with heated air. The one or more curved pads are constructed such that the substantially curved path is curved with an axis of curvature substantially perpendicular to the feed direction of the printing plate. The plate is additionally elastically bent to follow and conform to the substantially curved path. The substantially curved path minimizes printing plate distortion during heating, and thus prevents the plate from being damaged from contact with any of the one or more curved pads. The one or more curved pads are also arranged to allow for exceptionally good heat transfer characteristics and thus more effective plate heating.

19 Claims, 4 Drawing Sheets

METHOD AND APPARATUS FOR RAPIDLY HEATING PRINTING PLATES

CROSS-REFERENCE TO RELATED APPLICATION

This application relates to provisional application 60/634,748, filed Dec. 10, 2004.

FIELD OF THE INVENTION

The invention pertains to the field of ovens and, in particular, to ovens for rapidly heating printing plates.

BACKGROUND OF THE INVENTION

Printing operations undertaken in an offset printing press typically utilize lithographic printing plates. These lithographic printing plates are produced in a separate process involving the exposure of an image onto a plate substrate that typically comprises a thin aluminum alloy suitably treated so as to be sensitive to light or heat radiation.

One process of making a lithographic plate suitable for use on an offset printing press has been to employ a film mask. Exposing highly sensitive film media using a low power laser printer known as an "image-setter" typically produces this film mask. The film media is usually processed in some manner and is then placed in area contact with a photosensitive lithographic plate, which is in turn, "flood" or "area" exposed through the film mask. Such plates are referred to as "conventional printing plates". The most common conventional printing plates used in such a process are sensitive to radiation in the ultraviolet region of the light spectrum. Typically, it is usually further necessary to amplify the difference between the exposed and un-exposed areas in a further chemical processing step that removes the unwanted coating and converts the plate into a lithographic printing surface ready for use on the press.

More recently, a method of exposing a lithographic printing plate directly through the use of a specialized printer known as a plate-setter has gained popularity. A plate-setter in combination with a computer system that receives and conditions image data for sending to the plate-setter is commonly known as a Computer-to-Plate or "CTP" system. CTP systems offer a substantial advantage over image-setters in that they eliminate the film mask and the associated process variation associated with that extra step. The CTP system receives the image data and formats it to make it suitable for outputting to an exposure head within the plate-setter. The exposure head in turn controls a radiation source, which is typically a laser, so as to image picture elements (pixels) on the lithographic plate according to the image data.

Lithographic printing plates imaged by CTP systems are typically referred to as "digital" printing plates. The radiation beams emitted by the exposure head induce a physical or chemical change to a coating on the digital plates. Currently, digital plates comprise either: 1) high-sensitivity photopolymer coatings ("visible light plates") or 2) thermal photosensitive coatings ("thermal" plates). Visible light plates are typically exposed by a blue-violet laser diode of 10-100 mW. High power IR lasers in the range of 1 W to 100 W are used to expose thermal digital plates.

Like lithographic printing plates produced using film-based methods, many types of exposed or imaged digital printing plates typically undergo a further chemical processing step that removes the unwanted coating and converts the plate into a lithographic printing surface ready for use on the press.

Regardless of the method employed to image or expose a lithographic printing plate, the exposed printing plate is often pre-heated or pre-baked in an oven prior to being washed in a chemical solution during the subsequent chemical processing step. Additionally the processed printing plate can also be post-baked in another oven after the chemical wash step.

Once exposed or imaged, the printing plate typically undergoes the pre-heat step so as to render the image-wise exposed areas of the printing plate insoluble in the subsequent chemical development or processing steps. Hence, the un-exposed areas of the printing plate remain soluble and are washed away in the chemical baths to produce a final printing plate with the necessary differentiation between print areas and non-print areas. Typically, when the printing plates are exposed in a CTP plate-setter and then undergo this pre-heat step, the printing plates are referred to as "negative" or "negative-working" plates. Negative plates that are exposed with the use of conventional film masks are characterized such that the desired "printing image" will be exposed during the subsequent flood exposure. Likewise, negative plates that are imaged by a CTP system are characterized such that the desired "printing image" is imaged by the CTP plate-setter itself. In this context, the term "printing image" refers to the image that ultimately is printed on the press. In either case however, the printing image exposed on the printing plate is made insoluble by the pre-heat step such that it remains intact after the subsequent processing step. "Positive", or "positive working" plates are essentially the opposite of negative plates. Accordingly, the background image or the non-printing image is directly exposed onto positive plates. Exposed positive plates typically do not undergo a pre-heat step. In fact, the exposed background images are rendered soluble upon exposure. Consequently, a positive plate can be chemically processed such that the exposed or imaged background is washed away to produce a final printing plate that comprises the necessary print image required on press.

Post-baking of a processed printing plate is usually conducted to impart specific characteristics to the printing plate. Such characteristics can include increasing plate life on press. Some plate manufactures claim that plate life can be increased as much as five fold. Different criteria can be used to determine when plate has reached its end-of-life. One such criteria suggests that a plate has reached its end-of-life when more than 25% of 200 lpi 1% dots imaged on the plate are worn off during printing (as determined visually). The benefits of post-baking are not limited to any one type of plate. Conventional and digital plates can be post-baked in accordance with their respective manufacturer's instructions.

Pre-heat and post-bake ovens have typically been conveyor ovens. Such an oven is disclosed in U.S. Pat. No. 6,323,462 (Strand).

Conveyor ovens typically need to be kept on all the time since their warm-up time is lengthy. Conveyor ovens are typically very large in size and thus require substantial space requirements. These space limitations are further exasperated when a processing line requires both pre-heat and post-bake capability. Consistent and uniform oven temperatures have a significant effect on the quality of the processed plate, thus further increasing the complexity of conveyor ovens which includes a myriad of blowers, heating elements and extensive ductwork. Ovens that comprise inductive heating (also known as RF heating) means or microwave heating means can offer instant warm up, but are expensive since they require many kilowatts of power at high frequencies.

Pressurized fluid bearings (also known as hydrostatic bearings) are well known in the art of tribology and have been used in processing equipment. U.S. Pat. No. 5,239,327

(Frank) describes the use of a plurality of hydrostatic bearings within a chemical processing tank. The hydrostatic bearings are submerged within a processing solution that is used to process a film web. In this patent, each of the bearings comprise a pair of juxtaposed housings on opposite sides of the film web. Each of the housings includes an aperture for emitting liquid under pressure so as to support the web without it physically contacting the housings. Frank discloses that the film web within the processor does not follow a linear path, and as such, in the curved potions of the web path, the juxtaposed face surfaces of the bearing houses are curved to define the necessary web path there-between.

A pressurized air bearing (also know n as an aerostatic bearing) is similar to any pressurized fluid bearing, except the fluid is air. Like hydrostatic bearings, pressurized air bearings have a porous or perforated plate, known as a bearing pad, through which pressurized air is pumped through and prevents contact between the pad and the moving object. The bearing pads can incorporate any air-permeable arrangement and include uniform and distinctly shaped openings or randomly formed openings created by sintered plates as an example. An air bearing can be single or double sided. In the later embodiment, the object glides between two parallel pads without touching either one and with practically no friction.

It has been shown in the prior art, that air bearings are capable of exhibiting exceptionally fast heat transfer to a planar object such as a printing plate. In regular convection ovens most of the heated air bypasses the printing plate, therefore heat transfer efficiency is low. In a heated air-bearing oven, most of the heated air can be forced to flow through a relatively small parallel gap between the printing plate and the bearing pads, thereby resulting in very good heat transfer. Another advantage is that such a heated air bearing oven is very small and has low thermal mass since there is no requirement to heat up a large enclosure.

However, one disadvantage of an air-bearing oven is that that the heat transfer efficiency is greatest when the planar surface of the printing plate is within a very small distance of the heated bearing pads. Consequently, it is desired to keep this distance, or alternatively, the gap between any two adjacent heating pads as small as possible to promote rapid heating. A plate however typically distorts upon heating and this distortion can cause the plate to contact a heating pad when such small distances and gaps are employed. This contact can cause damage to the plate, especially to its relatively delicate photopolymer or thermal photosensitive coating. Such damage would be highly undesirable as it would likely lead to on-press printing artifacts. This damage may be avoided by increasing the air bearing distance or gap, but at a cost of reduced heat transfer efficiency.

EP 0 864 944 A1 (Oelbrandt et al.) discloses an air bearing device that comprises two flat, planar air bearings plates used to heat an imaging element that can include various forms of paper, film, plastics, laminates and printing plates. It also discloses that the spacing between the two flat air bearing plates is in the range of 2 to 20 mm and that hot air is applied to both sides of imaging element within this spacing such that substantially equal flows at substantially equal air temperatures are created.

U.S. Pat. No. 5,181,329 (Devaney, Jr. et al.) discloses an apparatus for the drying of conventional film and paper during a photo processing operation. It also describes drying a web of paper or film between a pair of spaced, parallel air bearing members having flat surfaces defining a channel through which heated air is used to support the web. In addition to the air bearing air inlet holes, air bearing evacuation holes are provided at a predetermined distance from the inlet holes so as to maintain the heat transfer rate in the channel higher than the heat transfer rate in the web.

Clearly, there is a need for a simple oven capable of a rapid warm up. Further, such an oven should be compact and have a high thermal efficiency. Finally, such an oven should not contact the surface of the lithographic printing plate that is coated with a photopolymer or thermal photosensitive coating. Needless to say, any contact may result in damage to the exposed or imaged coating, ultimately resulting in undesired on-press printing artifacts.

SUMMARY OF THE INVENTION

The present invention provides a method for heating a planar printing plate, the method comprising:

pressurizing and heating a flow of air, moving the planar printing plate along a substantially curved path, wherein the substantially curved path is adjacent to a first curved surface, the first curved surface comprising:

a plurality of openings, the plurality of openings being operable to convey at least a part of the flow of air, bending the planar printing plate as it is moved along the substantially curved path, and conveying the at least a part of the flow of air through the first curved surface wherein at least a portion of the planar printing plate along the substantially curved path is heated by the at least a part of the flow of air, and is prevented from contacting the first curved surface by the at least a part of the flow of air.

In another aspect, this invention provides an apparatus for heating a planar printing plate, the apparatus comprising:

a plate feeding means operable for moving the planar printing plate along a substantially curved path within a gap, a blower operable for creating a flow of air that is pressurized, a heater operable for heating the flow of air, and at least two curved surfaces arranged to establish the gap and the substantially curved path within the gap, wherein:

the at least two curved surfaces comprise a first convex surface and a second concave surface, the first convex surface and the second concave surface each having at least one substantially equal radius of curvature, and at least both the first convex surface and the second concave surface, each comprises a plurality of openings operable to convey a portion of the flow of air into the gap to heat at least a portion of the planar printing plate within the gap.

In accordance with this invention, a method and apparatus are disclosed for rapidly heating a planar printing plate as the plate moves through a heated air bearing. The heated air bearing comprises one or more curved heating surfaces. The planar printing plate is moved along a substantially curved path that is adjacent to at least one of the curved heating surfaces. While the plate is being moved along the substantially curved path, it is bent to substantially conform to the path. Each of the heating surfaces additionally comprises a plurality of openings that allow a flow of air to be conveyed towards the plate as the plate travels along the substantially curved path. Air is pressurized and heated and is conveyed through each of the heating surfaces. The planar printing plate is fed into heated air bearing and is bent by the flow of pressurized and heated air so as to conform and follow the contour of the substantially curved path. Alternatively, the printing plate can be bent or supported by additional mechanical means so as to conform and follow the substantially curved path through the air bearing. In either case, the portion of the planar printing plate moving along the substantially curved path is heated by the pressurized and heated flow of air. Since this portion of the plate has been bent to follow the curved path, the stiffness of this portion of the printing plate is increased considerably. This in turn helps to counter thermal distortion effects that occur from heating the plate from ambient temperature conditions and can cause the printing plate to distort and contact the heating surfaces, thus potentially damaging the plate. Therefore, this method of heating the printing plate allows for a smaller distance between the planar surface of the printing plate and any of the heated curved surfaces while minimizing potential damage to the plate itself. Consequently, the gap between two adjacent surfaces can also be made smaller. This smaller distance and gap, in turn increases the thermal heat transfer efficiency of the air bearing, thus promoting a rapid and energy efficient heating of the printing plate. A compact, energy efficient apparatus can be created to heat printing plates by this method. Such an apparatus additionally benefits from quick warm up times, and thus advantageously further reduces power consumption.

DETAILED DESCRIPTION OF THE INVENTION

Figure 1:
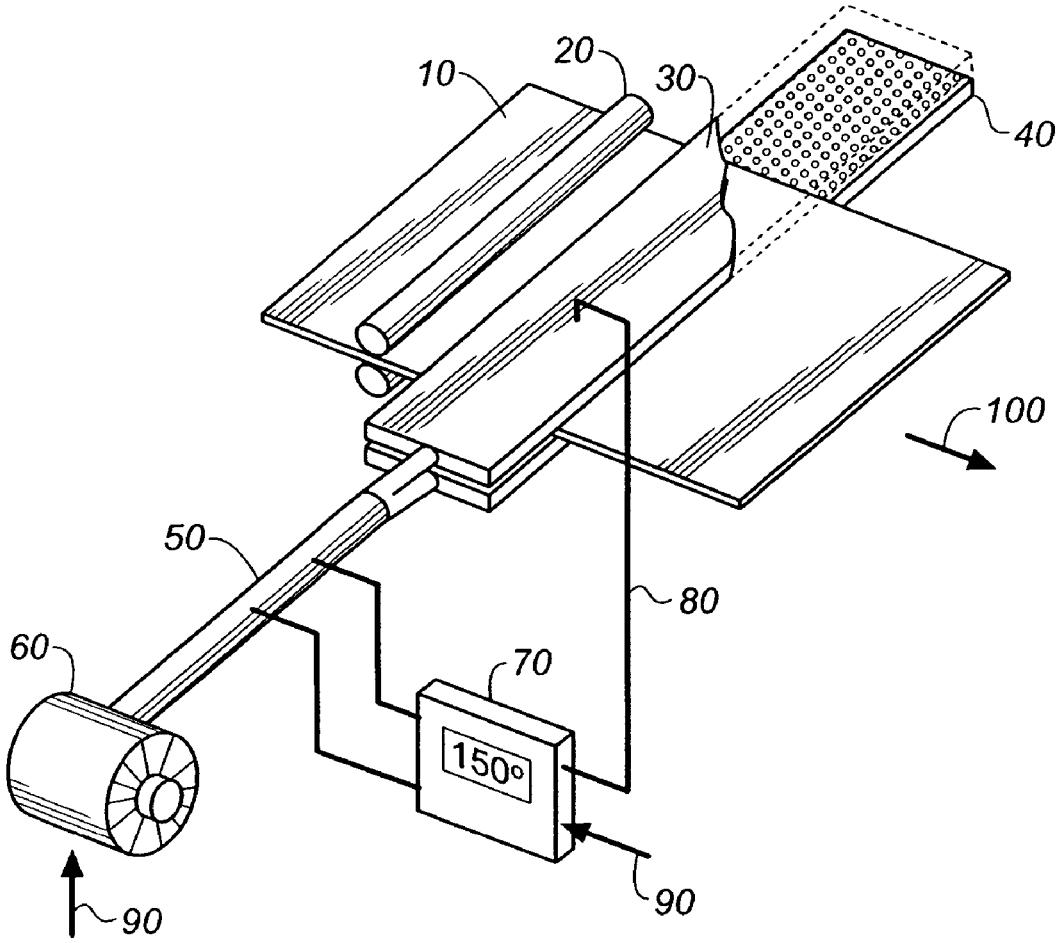
FIG. 1 shows an isometric view of an embodiment of the invention.

Regardless of whether a given printing plate is a "conventional" plate that is exposed through a film mask or a "digital" plate that is imaged by a CTP imager, the printing plate typically comprises a polyester or metal substrate. Further, aluminum and aluminum alloys are the preferred choice of most metal-based printing plates. Both polyester and metal printing plates are susceptible to thermal changes. Additionally, polyester is also susceptible to humidity changes. Both aluminum and polyester have coefficients of thermal expansion of approximately 20-23 μm/m/° C. (or 20-23 parts per million (ppm)/° C.). The coefficient of thermal of expansion is a material specific constant used to estimate the change in length or size that an object undergoes when heated or cooled from a known temperature. Required oven pre-heating temperatures are typically in range of from about 100 to about 250° C. above ambient conditions. As previously stated, the prior art has disclosed air bearing heating devices that comprise substantially planar air bearing pads. Experimentation has determined that when a printing plate is introduced into such a prior art device, its leading edge is heated as would be expected by the stated air bearing temperatures. This leading edge portion of the plate thus inclined to expand accordingly. For example, the leading edge portion of a typical aluminum printing plate approximately 0.3 mm thick and 1 meter in width, would be inclined to expand approximately 2 to 5 mm due to the 100 to 250° C. air bearing temperatures. However, the remaining portion of the plate that has not entered the heated air bearing does not expand since it is still exposed to ambient air temperatures. The heated leading edge portion of the plate is thus constrained from expanding due to the heated air bearing temperatures, and consequently the leading edge portion of the plate buckles. For the example given, the 1 meter wide plate may buckle up to 2 to 4 mm under these conditions. If these prior art planer air bearing pads are not sufficiently spaced apart, the buckled leading edge potion of the plate will strike at least one of the pads. Consequently, the imaged or exposed coating on the printing plate may be damaged and thus ultimately result in undesirable on-press printing artifacts.

These difficulties may be overcome by spacing the planar air bearing pads further apart to produce a large "air bearing gap" or "gap". Although this may prevent damage to the printing plate coating, the thermal transfer efficiency of the heated air bearing is reduced. For a typical aluminum printing plate comprising a thickness of 0.3 mm, it has been shown that the greatest thermal heat transfer occurs when the air-bearing gap is under 1 mm, or approximately three times the thickness of the plate. If the air bearing gap where to increase to 2 mm, the thermal transfer efficiency would be reduced by from about 30% to about 50%. Gaps of from about 10 to about 20 mm substantially limit the air bearing thermal transfer. For example, in a heated air bearing comprising a 1 mm gap, a 0.3 mm thick plate was heated to 90% of final temperature in 5 seconds. The same plate, however took 20 seconds to reach same temperatures when the gap was increased to 10 mm and the same airflow and heating conditions were used. Therefore, it has been found that increasing the gap to counter the plate-buckling problem reduces the heating efficiency of the heated air bearing. Clearly, although a heated air bearing has the potential to produce a compact oven, improvements are needed to reduce printing plate coating damage while maintain high heating efficiency.

Referring now to FIG. 1, an embodiment of the invention is shown. A printing plate 10 is fed along direction 100 into the oven by a plate feeding mechanism comprising drive rollers 20 (or any other suitable feed means such as a conveyor or web). Since drive rollers 20 contact both planar surfaces of printing plate 10, the nip pressure between drive rollers 20 and printing plate 10 roller composition should be appropriately chosen so as to minimize the potential of damaging the exposed or imaged coated planar surface of plate 10. A suitable drive roller material has been found to be silicone rubber (to resist the heat) with a 70 durometer (Shore A) hardness. However, any appropriate plate feeding mechanism may be alternately employed. A plate feeding mechanism that comprises a conveyor may be chosen to avoid contact with the coated surface of printing plate 10 altogether. The oven comprises of a top heating pad 30 and a bottom heating pad 40, both being air bearing or conveying. Blower 60 in conjunction with air heater 50 is operable to create a pressurized and heated airflow. Portions of this pressurized and heated airflow are directed and forced though each of the heating pads 30 and 40. The air temperature is controlled by temperature controller 70 and a measuring probe 80 that is inserted into the airflow. Measuring probe 80 preferably comprises a fast responding thermocouple sensor. A source of power 90 is supplied at least to both the heating controller 70 and blower 60. Power source 90 can be switched and supplied only when needed. That is, the oven is only required to be in a "heating mode" in which heated air comprising the necessary temperature and airflow conditions is provided only when printing plate 10 is available to be heated. This mode of operation would require an oven warm up time measured typically in the range of about 5 minutes. Taking into account this warm-up time and the feed rate of the feed mechanism, power 90 is accordingly provided when printing plate 10 has reached some predetermined position prior to reaching the heated air bearing. Any contact or contact-less sensor (not shown) can be used to determine when printing plate 10 is at the correct predetermined position and thus engage power source 90 to creating an energy-efficient automated heating line.

In the example of the invention shown in FIG. 1, blower 60 is operable to create an air pressure of about 200 millibars ("mbar") when the oven is in its heating mode. A pressure working range from about 50 to about 500 mbar has also provided satisfactory results. Blower 60 must be further operable to create the necessary airflow conditions required. Specifically, the required airflow will depend on, among other things, the size of the plates to be heated as well as the rate in which plates will need to be heated. For continuous feeding of a 0.3 mm thick aluminum printing plates, an airflow of approximately 20 liters/sec/m width of plate was found suitable (that is, air bearing temperatures of 100 to 250° C.) when a 3 to 5 kilowatt air heater 50 was used. The length of the heating pads (that is, along the feed direction 100) is chosen to allow any portion of the plate to spend at least a few seconds between the two heating pads 30 and 40. In one specific embodiment tested, the plate feed rate was 1 m/min and the length of the heating pads was 15 cm, producing a heating "dwell time" of about 10 seconds. Heating dwell times as short as 2 seconds have been tested successfully.

In another embodiment of the invention, the airflow created by blower 60 is kept at a very low level when the heated air bearing is not in use while the air temperature is continuously maintained at its "heating mode" operating level. Because of the low airflow, power consumption is low as well. Typical airflow in this embodiment of the invention is approximately 10% of the levels required during actual heating of the plate (that is, 2 liters/sec as opposed to a 20 liters/sec heating mode value), and the actual power consumption in this mode is about 20% of normal for a well-insulated oven. In this embodiment, when printing plate 10 is sensed or detected, blower 60 increases the airflow to its heating mode value. Because the heater is already at the necessary heating temperature, warm up is achieved very quickly and is typically well under 1 minute. A suitable systems controller (not shown) can be used to control the operation of the plate feed mechanism, the blower and heater to control the warm-up time and operating heating conditions of any of the embodiments of the invention. In other embodiment of the invention the operation of plate feeding mechanism (e.g. rollers 20), blower 60, and heater 50 can be controlled by a CTP device that controls the imaging rate of plates and consequently determines when the oven should undergo any necessary warm-up cycle and when a given plate should be heated.

Figure 2A:
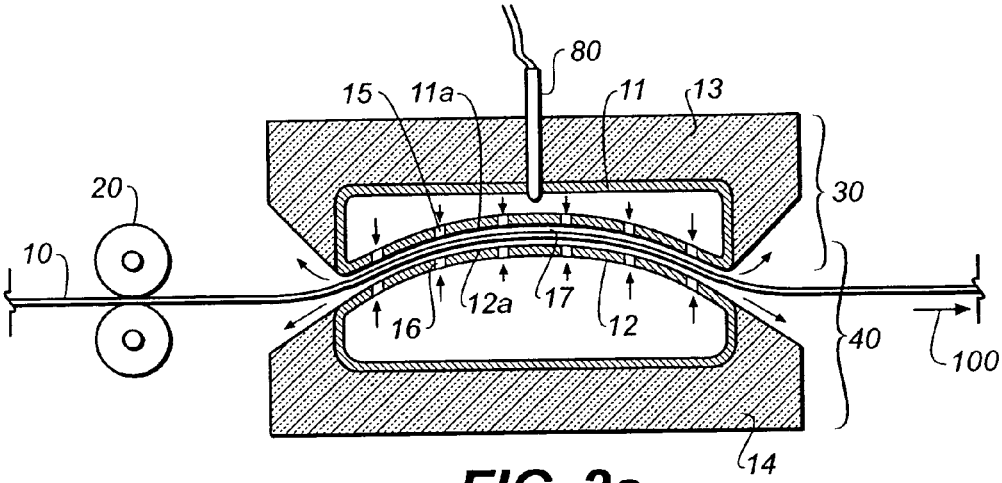
FIG. 2*a* shows a cross sectional view of the air bearing of an embodiment of the invention.

FIG. 2*a* shows a cross section of the upper and lower heating pads 30 and 40 of an embodiment of the invention. Channels 11 and 12 are respectively insulated by thermal insulation 13 and 14. In this embodiment, channel surfaces 11*a* and 12*a* are curved such that each respective axis of curvature is perpendicular to the feed direction 100 of printing plate 10. Specifically, channel surface 11*a* has a concave shape while opposing surface 12*a* has a complimentary convex shape. Both channel surfaces 11*a* and 12*a* complimentary match one another to define a substantially equally sized gap 17 and a substantially curved path within gap 17. The substantially curved path is adjacent to at least one of the curved channel surfaces 11*a* and 12*a*. It is to be noted that other embodiments of the invention are not precluded from reversing the orientation of convex and concave surfaces. In the embodiment shown in FIG. 2*a*, channel surfaces 11*a* and 12*a* maintain a consistent curved profile throughout the width of heating pads 30 and 40. In this context, the "width" of upper and lower heating pads 30 and 40 refers to the aspect of the pads that is aligned with the planar width of printing plate 10 (the planar width of printing plate 10 being perpendicular to the feed direction 100 of printing plate 10). It has been discovered that by thus imparting a matching curvature into the surfaces 11*a* and 12*a*, printing plate 10 will assume a similar curvature as it proceeds through the substantially curved path established in the air-bearing gap 17. It should be noted that the heated and pressurized flow of air that is forced though the heating pads 30 and 40 will cause printing plate 10 to bend and assume this similar curvature as it travels along the substantially curved path. Therefore, by imparting this curvature into printing plate 10, the stiffness of printing plate 10 is significantly increased and can counter the distortion that printing plate 10 may undergo as it enters the heated air bearing from ambient temperature conditions. Damage to the imaged or exposed coating of printing plate 10 is substantially avoided since the coated plate is prevented from distorting and adversely contacting channel surfaces 11*a* and 12*a*.

The substantially curved path defined by channel surfaces 11*a* and 12*a* can assume any continuous arc-like profile (e.g. segments of circular, parabolic, elliptical profiles). Profiles are chosen with a preferred radius of curvature of approximately 250 mm, although at least one radius of from about 200 to about 1000 mm was also found to work well. It is to be noted that as printing plate 10 travels through the substantially curved path established in the heated air bearing gap 17, the curvature imparted to printing plate 10 should be elastic in nature, since printing plate 10 should resume its inherent planar nature once it travels beyond heating pads 30 and 40. Maintaining the plate's inherent planar nature is important since the plate should remain flat during any subsequent chemical processing steps. Consequently, the arc-like profiles of channel surfaces 11*a* and 12*a* should be chosen to have a degree of curvature sufficiently large so as to not impart a permanent set or bend into printing plate 10 as it travels through the substantially curved path. Further, large lead-ins into channel surfaces 11*a* and 12*a* should also be incorporated so as to avoid imparting a permanent set into printing plate 10 as it enters gap 17.

It is conceivable that channel surfaces 11*a* and 12*a* can have substantially matching curved surfaces, each with a respective axis of curvature that is parallel to the feed direction 100 of printing plate 10. Such an embodiment may however pose additional challenges of "transitioning" an essentially planar printing plate 10 from the plate feeding mechanism into a curved entrance created by upper and lower heating pads 30 and 40. Such an embodiment would likely require additional space and means to transition the planar printing plate 10 into a suitable profile to successfully enter such a heated air bearing. Additionally, as previously stated, the embodiment of the invention shown in FIG. 2*a* comprises channel surfaces 11*a* and 12*a* that maintain a consistent profile throughout the lengths of heating pads 30 and 40. Changing this profile so that it additionally varies along the lengths of the heating pads 30 and 40 would additionally stiffen printing plate 10 by imposing a compound curve into it. This configuration can impart a great deal of stress into the plate, and thus along with the previously stated "transitioning" challenges is felt to be unnecessary.

Referring back to FIG. 2*a*, channel surfaces 11*a* and 12*a* are respectively perforated with a plurality of small supply openings 15 and 16. In this embodiment of the invention, supply openings 15 and 16 preferably face each other to decrease airflow (and heat loss) when no portion of printing plate 10 is within gap 17. Again, gap 17 is defined between channel surfaces 11*a* and 12*a*. Further, gap 17 is preferably sized to increase the heated air bearing thermal transfer efficiency and ideally depends on the printing plate 10 thickness. Preferably, gap 17 is approximately 3 times the plate thickness. Typical plates range in thickness from about 0.1 to about 0.5 mm. Consequently a suitable range for gap 17 between the first and second curved surfaces is from about 0.75 to about 1.5 mm and preferably from about 0.75 to about 1.0 mm. It should be noted that with such relatively small gaps, the profiles of surfaces 11*a* and 12*a* are substantially matched.

Figure 2B:
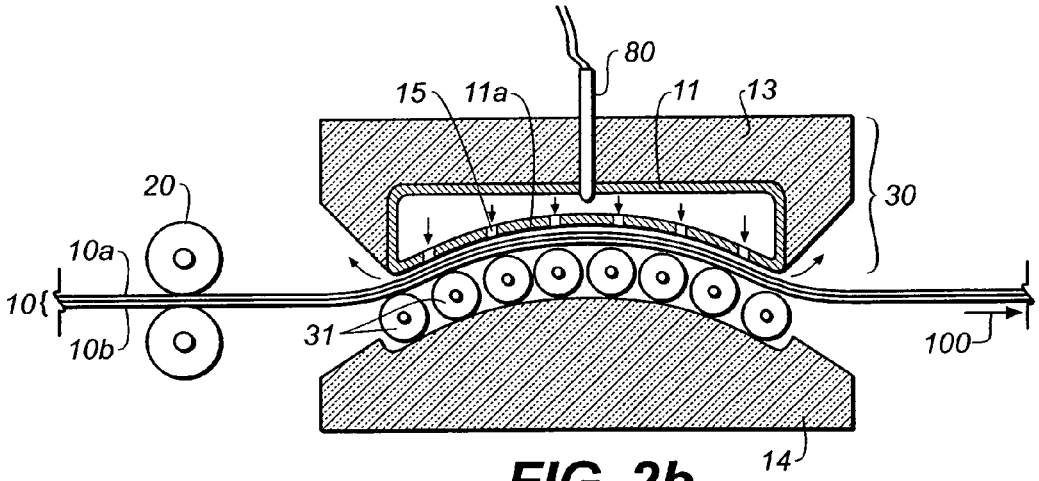
FIG. 2*b* shows a cross sectional view of the air bearing of another embodiment of the invention.

FIG. 2*b* shows a cross section of a single-sided air bearing used by another embodiment of the invention. In this embodiment of the invention, a single heating pad 30 is positioned such that it is adjacent to the photopolymer or thermal photosensitive coating 10*a* of printing plate 10. Heated air is provided through a plurality of supply openings 15 so as to provide a heated air cushion for the heating of printing plate 10. Additionally, this heated air cushion separates photosensitive coating 10*a* from channel surface 11*a*, thus minimizing any potential damage to photosensitive coating 10*a*. The uncoated side 10*b* of printing plate 10 is supported by any suitably curved support means such as a plurality of heat resistant rollers 31. Uncoated side 10*b* is more resistant to damage than photosensitive coating 10*a* and has a lesser impact on preventing on-press printing artifacts. Consequently, uncoated side 10*b* can contact rollers 31 or any other contact based support means so long as the plate material itself is not kinked or galled. In this embodiment, the plurality of contact rolls 31 is arranged to minimize the distance between photosensitive coating 10*a* and channel surface 11*a*. Rollers 31 are further arranged to help define a substantially curved path through which printing plate 10 may be fed through during the heating operation. This distance is preferably minimized to increase thermal transfer efficiency. Heated air, provided through a plurality of supply openings 15, causes printing plate 10 to bend so as to be supported by rollers 31 and to conform to, and follow the substantially curved path. In other embodiments of the invention comprising a single-sided air bearing, printing plate 10 is bent by any mechanical means capable of applying a bending moment to printing plate 10. Such mechanical means are used to help conform printing plate 10 to a desired substantially curved path established adjacent to channel surface 11*a*. Such mechanical means can include a series of heat-resistant nip rollers positioned at the entrance and exit of the single-sided air bearing and arranged to bend printing plate 10 so as to transition it into and away from the desired substantially curved path. Such mechanical means can be used to as the primary means of bending the plate to conform to the substantially curved path, especially when printing plate 10 comprises a continuous web of plate material. Alternatively, the bending of printing plate 10 can additionally be supplemented by at least the "bending action" created by the flow of air through supply openings 15 in channel surface 11*a*.

Figure 3A:
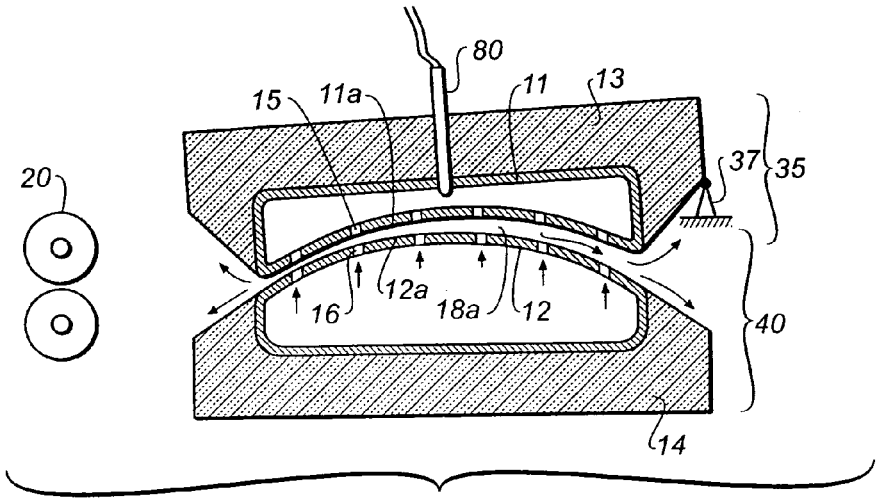
FIG. 3*a* shows a cross sectional view of the air bearing of yet another embodiment of the invention.
Figure 3B:
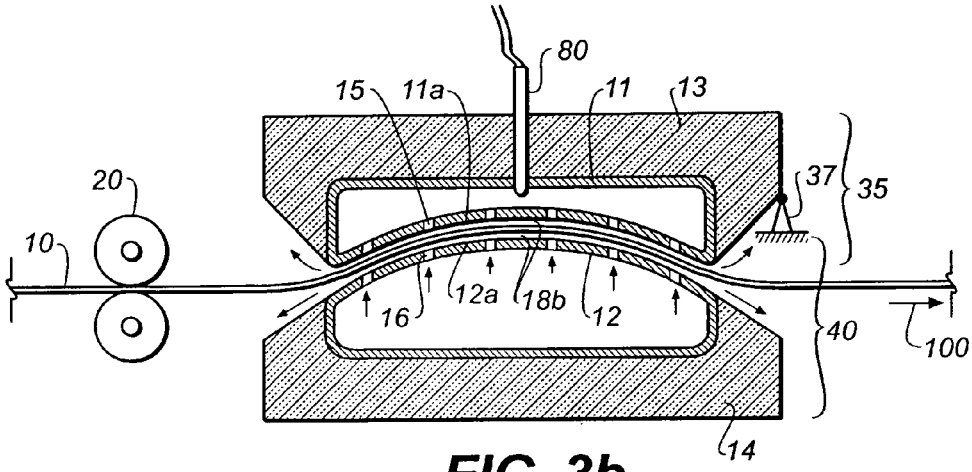
FIG. 3*b* shows another cross sectional view of the air bearing of yet another embodiment of the invention.

FIGS. 3*a* and 3*b* show another embodiment of the invention. Unlike the embodiment shown in FIG. 2*a* in which the position of heating pads 30 and 40 are fixed to produce a substantially constant gap 17, hinged upper heating pad 35 is arranged with hinge 37 that can comprise any suitable mechanical hinging means or flexure. Hinge 37 allows the hinged upper heating pad 35 to rotate towards and away from fixed lower heating pad 40. In FIG. 3*a*, printing plate 10 has not been introduced into the air bearing. Consequently a tapered gap 18*a* results wherein the minimum spacing of gap 18*a* is determined from the air bearing airflow conditions that exist from the absence of printing plate 10. This minimal tapered gap 18*a* advantageously reduces the airflow losses (and associated heat losses) during the time that the plate has not entered the heated air bearing. In FIG. 3*b*, printing plate 10 has entered the heated air bearing and the upper heating pad 35 has rotated upwards to form gap 18*b*. By predetermining the air bearing pressure within gap 18*b* that would result as a consequence of the presence of printing plate 10, and appropriately weighting the upper heating pad 35, a desired gap spacing between each planar surface of plate 10 and its juxtaposed heating pad can be achieved. Consequently, in this embodiment, these system parameters can be designed to produce a suitable gap that can increase thermal transfer efficiency. Additionally, this desirable gap 18*b* with its associated preferred thermal transfer efficiency is substantially the same for different plate thicknesses. Other embodiments of the invention would not incorporate hinge 37. Rather, upper heating pad 35 could be a free-floating member that would be constrained to only translate towards and away from fixed lower heating pad 40.

Figure 4:
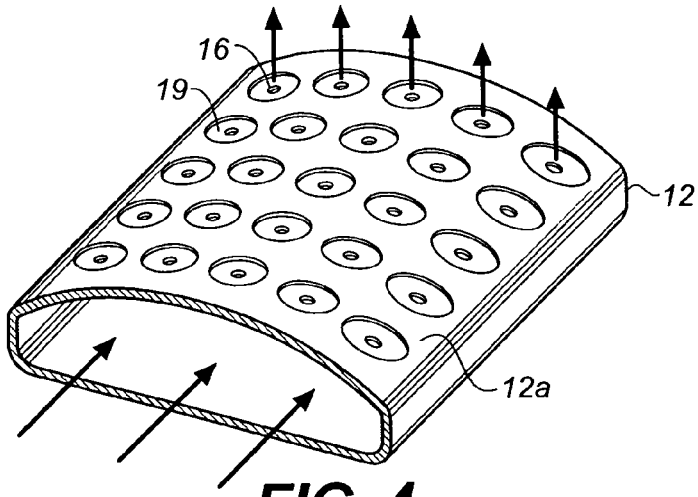
FIG. 4 shows an isometric view of the air bearing hole pattern of an embodiment of the invention.

In order to increase the efficiency of the air bearing, it may be desirable to provide a shallow depression around each of the plurality of supply openings 15 and 16. This increases the lifting force should printing plate 10 try to block any of the supply openings 15 and 16, and is standard practice in air bearing design. Such an opening pattern is shown in FIG. 4. Each supply opening 16 is surrounded by a shallow depression 19. In other embodiments of the inventions, supply openings 15 and 16 can be replaced by pads comprising a porous material such as porous graphite or sintered metal.

Figure 5:
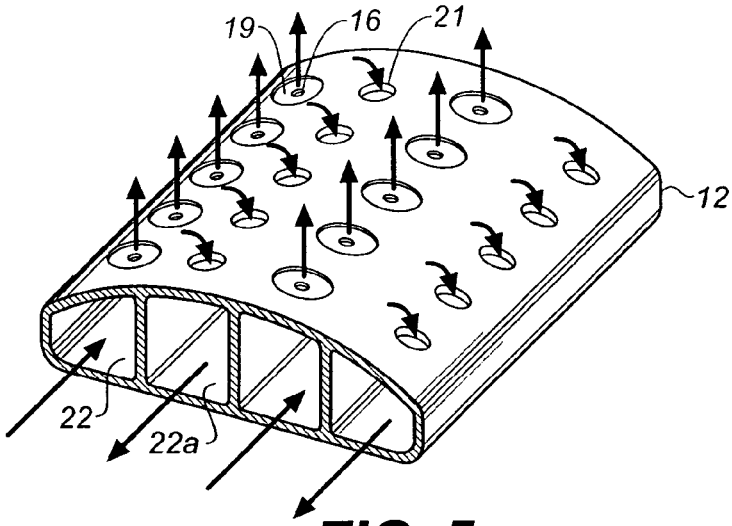
FIG. 5 shows an isometric view showing an embodiment of the invention that re-circulates the heated air.
Figure 6:
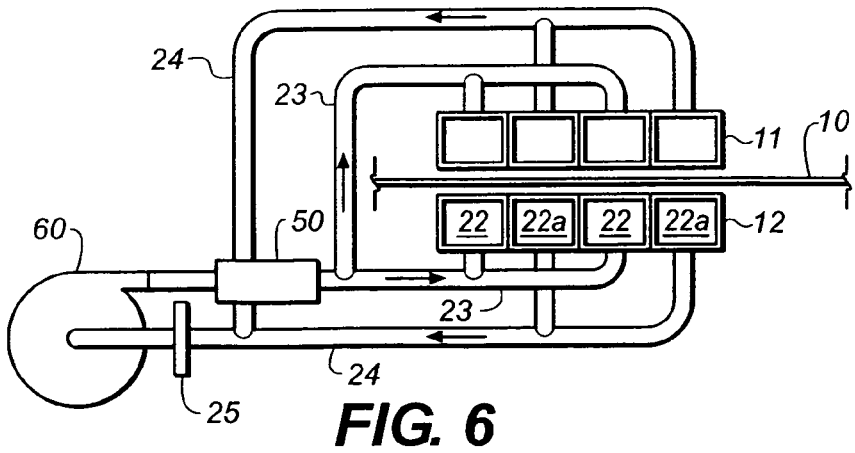
FIG. 6 shows a schematic view of the air re-circulation layout of a preferred embodiment of the invention.

Re-circulating and re-using the hot air after it passed across printing plate 10 can further increase thermal transfer efficiency. Other advantages of air re-circulation include avoiding heating up surrounding objects due to escaping hot air and the ability to filter the flow of air or to trap or destroy any volatile emissions emanating from the heated plate. In such a re-circulating system a return path is provided for the hot air, as shown in FIG. 5 by a plurality of exhaust openings 21 and exhaust duct 22*a*. The hot air arrives via supply duct 22, emerges via supply openings 16 and returns in whole, or in part, via exhaust openings 21 and duct 22*a*. FIG. 6 shows a piping layout suitable for such a re-circulation arrangement. Blower 60 and heater 50 respectively pressurize and heat the air that is fed via supply pipes 23 and is returned via return pipes 24. A filter 25 can trap liquids or volatile compounds. Heater 50 can additionally include a catalytic converter (not shown, but similar to the one used in motor vehicles) to decompose organic compounds into simple gasses such as $CO_2$, $NO_2$, and water vapor. A catalytic converter can be used for reduction of organic deposits in the system. Since the blower 60 is operating at a high temperature it is required to use a suitably rated blower. Such blowers preferably have the motor separated from the blower turbine, to avoid heating of the motor.

By the way of example, a system was tested using the following parameters:

- Aluminum printing plates, 0.1 to 0.4 mm thickness, up to 900 mm wide.
- Temperature range: from 150 to 250° C. (the lower temperature is used for the pre-heat step on those plates and the higher temperature is used in a post-bake step).
- Blower: Ametek brushless blower, Windjammer series. 500 W.
- Heater: double coiled filament in 40 mm diameter tube, 220 V, 8000 W (the high power heater is only needed for rapid warm-up; heater power can be reduced considerably if this is not a requirement).

Temperature controller: Omega model CN132 with type K thermocouple

Air bearing: 100×150 mm cross section with a 500 radius of curvature and 0.5 mm holes on 20 mm grid, 0.3 mm recess 10 mm diameter around each hole, 1 mm air gap.

The heating time required to reach 150° C. with this oven was 5 seconds for the thickest plate (0.4 mm). The warm-up time for the whole oven was under 5 minutes from a cold start, and less than 30 seconds in a reduced airflow mode in which the oven stayed hot but the airflow was reduced when the oven was not in a heating mode. The system was used to pre-heat and post-bake thermal printing plates imaged on a Creo Trendsetter 3244 computer-to-plate imager. Because of the short warm-up, the oven was only turned on when the imaging of the plate was started and the oven was fully ready by the time the plate was imaged, resulting in major energy savings compared to a current system in which the conveyor oven is kept on all the time. Additionally, none of the tested printing plates had their imaged coating scratched or damaged within the heated air bearing. The overall size of the tested oven is 170 mm×200 mm×1000 mm for plates up to 900 mm wide. This represents 10% of the volume of a conventional pre-heat oven.

The apparatus of the invention can be incorporated into and used in a lithographic plate processing line. Embodiments of the invention may be used in pre-heat oven wherein plates are thermally pre-sensitized prior to chemical processing. Pre-heat ovens incorporating an embodiment of the invention will typically be compact in nature and are thus suitable as stand-alone devices or may be an integral component of the chemical processor unit itself. Further, the quick warm-up time associated with a pre-heat oven comprising an embodiment of the invention also allow such an oven to be incorporated as an integral part of a computer-to-plate (CTP) device.

Additionally, embodiments of the invention may be incorporated into post-bake ovens used to impart additional characteristics to processed printing plates. Since embodiments of the invention allow for a compact design, a post-bake oven comprising an apparatus of the invention can be a stand-alone unit or incorporated into the chemical process itself.

Embodiments of the invention can be used to heat many types of lithographic printing plates that are described in numerous publications. The printing plates can include conventional printing plates that are exposed using a film mask and also digital plates that are imaged in a CTP device. Such digital plates can include plates that comprise photopolymer coatings or thermal photosensitive coatings disposed on a suitable substrate. Although conventional and digital printing plates are typically used in sheet form, methods and apparatus of the invention can also be used for heating printing plate materials that are in web form. Such embodiments of the invention are especially suitable for the manufacturing process of printing plates, wherein the plates undergo several heating cycles especially during the application of the photopolymer or thermal photosensitive coatings to the plate substrate.

OTHER METHOD EMBODIMENTS

The method of the invention wherein the substantially curved path is adjacent to a second curved surface, the second curved surface comprising a plurality of openings operable to convey at least an additional part of the flow of air, and wherein the method further comprises:

conveying the at least an additional part of the flow of air through the second curved surface, wherein the at least a portion of the planar printing plate along the substantially curved path is heated by the at least an additional part of the flow of air, and is prevented from contacting the second curved surface by the at least the additional part of the flow of air.

The method of the invention wherein the at least a portion of the planar printing plate along the substantially curved path comprises a photopolymer or thermal photosensitive coating, and the method further comprises:

conveying the at least a part of the flow of air through the first curved surface, wherein the coating is heated by the at least a part of the flow of air, and is prevented from contacting the first curved surface.

The method of the invention wherein the at least a portion of the planar printing plate along the substantially curved path comprises a photopolymer or thermal photosensitive coating, and the method further comprises:

conveying the at least a part of the flow of air through the first curved surface, wherein the coating is heated by the at least a part of the flow of air, and is prevented from contacting the first curved surface and the second curved surface.

The method of the invention comprising arranging the first curved surface and the second curve surface, wherein a gap is formed there between and the substantially curved path is established within the gap.

The method of the invention wherein the bending the planar printing plate comprises bending the at least a portion of the planar printing plate along the substantially curved path with at least one of:

the at least a part of the flow of air, and the at least an additional part of the flow of air.

The method of the invention further comprising arranging the first curved surface and the second curved surface, wherein the gap is substantially uniform along the substantially curved path.

The method of the invention further comprising arranging the first curved surface and the second curved surface, wherein the gap is smaller when the planar printing plate is not moved along the substantially curved path.

The method of the invention wherein the planar printing plate includes a thickness, and the method further comprising arranging the first curved surface and the second curved surface, wherein the gap is not greater than three times the thickness of the planar printing plate.

The method of the invention wherein the planar print plate is additionally moved along a feed direction, and the substantially curved path has at least one axis of curvature that is substantially perpendicular to the feed direction.

The method of the invention further comprising arranging the first curved surface and the second curved surface, wherein the substantially curved path has at least one radius of curvature and, wherein the bending the planar printing plate comprises bending the at least a portion of the planar printing plate along the substantially curved path with a radius of curvature that is substantially equal to the at least one radius of curvature.

The method of the invention wherein the bending the planar printing plate comprises elastically bending the planar printing plate.

The method of the invention wherein the method further comprises supporting the at least a portion of the planar printing plate along the substantially curved path with a support means, wherein the coating is prevented from contacting the support means.

The method of the invention wherein the bending the planar printing plate comprises applying a bending moment to the planar printing plate.

The method of the invention wherein the conveying the at least a part of the flow of air commences less than 5 minutes before the planar printing plate is moved along the substantially curved path.

The method of the invention wherein the flow of air comprises an airflow and the method further comprises reducing the airflow before the planar printing plate is moved along the substantially curved path.

OTHER APPARATUS EMBODIMENTS

An apparatus wherein at least one of the at least two curved surfaces is further operable to rotate towards and away from another of the at least two curved surfaces.

An apparatus wherein at least one of the at least two curved surfaces is further operable to translate towards and away from another of the at least two curved surfaces.

An apparatus further comprising an airflow re-circulation means.

An apparatus further comprising an airflow filtration means.

An apparatus further comprising a catalytic converter.

An apparatus further comprising a systems controller operable for controlling at least one of: the plate feed means, the blower, and the heater.

An apparatus wherein the planar printing plate is a conventional printing plate that has been exposed with a film mask.

An apparatus wherein the planar printing plate is a digital printing plate that has been imaged in a computer-to-plate device.

An apparatus wherein the planar printing plate is a negative digital printing plate that has been imaged in a computer-to-plate device.

An apparatus wherein the apparatus is an oven.

An apparatus wherein the oven is a pre-heat oven.

An apparatus wherein the oven is a post-bake oven.

An apparatus wherein the oven is an integral component of a chemical plate processor.

An apparatus wherein the oven is an integral component of a computer-to-plate device.

An apparatus wherein the planar printing plate comprises a web of printing plate substrate that is coated with one of: photopolymer coating, or a thermal photosensitive coating.

The invention has been described in detail with particular reference to certain example embodiments thereof, but it will be understood that variations and modifications can be effected within the spirit and scope of the invention.

PARTS LIST

10 printing plate
10*a* photosensitive coating on printing plate
10*b* uncoated side of printing plate
11 channel
11*a* channel surface
12 channel
12*a* channel surface
13 thermal insulation
14 thermal insulation
15 supply openings
16 supply openings
17 gap
18*a* tapered gap
18*b* gap
19 shallow depression
20 drive rollers
21 exhaust openings
22 supply duct
22*a* exhaust duct
23 supply pipes
24 return pipes
25 filter
30 top heating pad
31 heat resistant rollers
35 upper heating pad
37 hinge
40 bottom heating pad
50 air heater
60 blower
70 temperature controller
80 measuring probe
90 source of power
100 direction of printing plate movement

The invention claimed is:

1. A method for heating a planar printing plate, the method comprising:

pressurizing and heating a flow of air, moving the planar printing plate along a substantially curved path, wherein the substantially curved path is adjacent to a first curved surface, the first curved surface comprising:

a plurality of openings, the plurality of openings being operable to convey at least a part of the flow of air, bending the planar printing plate as it is moved along the substantially curved path, and conveying the at least a part of the flow of air through the first curved surface wherein at least a portion of the planar printing plate along the substantially curved path comprises a photopolymer or thermal photosensitive coating, and wherein the coating is heated by the at least a part of the flow of air, and is prevented from contacting the first curved surface by the at least a part of the flow of air, wherein the conveying the at least a part of the flow of air commences less than 5 minutes before the planar printing plate is moved along the substantially curved path.

2. The method of claim 1 wherein the substantially curved path is adjacent to a second curved surface, the second curved surface comprising a plurality of openings operable to convey at least an additional part of the flow of air, and wherein the method further comprises:

conveying the at least an additional part of the flow of air through the second curved surface, wherein the at least a portion of the planar printing plate along the substantially curved path and wherein said photopolymer or thermal photosensitive coating is heated by the at least an additional part of the flow of air, and is prevented from contacting the second curved surface by the at least the additional part of the flow of air.

3. The method of claim 2 comprising arranging the first curved surface and the second curve surface, wherein a gap is formed there between and the substantially curved path is established within the gap.

4. The method of claim 3 further comprising arranging the first curved surface and the second curved surface, wherein the gap is substantially uniform along the substantially curved path.

5. The method of claim 3 further comprising arranging the first curved surface and the second curved surface, wherein the gap is smaller when the planar printing plate is not moved along the substantially curved path.

6. The method of claim 3 wherein the planar printing plate includes a thickness, the method further comprising arranging the first curved surface and the second curved surface, wherein the gap is not greater than three times the thickness of the planar printing plate.

7. The method of claim 3 further comprising arranging the first curved surface and the second curved surface, wherein the gap is within a range of from about 0.75 mm to about 1.5 mm.

8. The method of claim 2 wherein the bending the planar printing plate comprises bending the at least a portion of the planar printing plate along the substantially curved path with at least one of:

the at least a part of the flow of air, and the at least an additional part of the flow of air.

9. The method of claim 2 further comprising arranging the first curved surface and the second curved surface, wherein the substantially curved path has at least one radius of curvature and, wherein the bending the planar printing plate comprises bending the at least a portion of the planar printing plate along the substantially curved path with a radius of curvature that is substantially equal to the at least one radius of curvature.

10. The method of claim 9 further comprising arranging the first curved surface and the second curved surface, wherein the at least one radius of curvature is from about 200 mm to about 1000 mm.

11. The method of claim 1 wherein the planar print plate is additionally moved along a feed direction, and the substantially curved path has at least one axis of curvature that is substantially perpendicular to the feed direction.

12. The method of claim 1 wherein the bending the planar printing plate comprises elastically bending the planar printing plate.

13. The method of claim 1 wherein the method further comprises supporting the at least a portion of the planar printing plate along the substantially curved path with a support means, wherein the coating is prevented from contacting the support means.

14. The method of claim 1 wherein the bending the planar printing plate comprises applying a bending moment to the planar printing plate.

15. The method of claim 1 further comprising at least one of:

re-circulating and reusing the flow of air, filtering the flow of air, and conveying the flow of air through a catalytic converter.

16. The method of claim 1 wherein the flow of air is pressurized to from about 50 mbars to about 500 mbars.

17. The method of claim 1 wherein the flow of air is heated to a temperature of from about 100 to about 250° C.

18. A method for heating a planar printing plate, the method comprising:

pressurizing and heating a flow of air, moving the planar printing plate along a substantially curved path, wherein the substantially curved path is adjacent to a first curved surface, the first curved surface comprising:

a plurality of openings, the plurality of openings being operable to convey at least a part of the flow of air, bending the planar printing plate as it is moved along the substantially curved path, and conveying the at least a part of the flow of air through the first curved surface wherein at least a portion of the planar printing plate along the substantially curved path comprises a photopolymer or thermal photosensitive coating, and wherein the coating is heated by the at least a part of the flow of air, and is prevented from contacting the first curved surface by the at least a part of the flow of air, wherein the substantially curved path is adjacent to a second curved surface, the second curved surface comprising a plurality of openings operable to convey at least an additional part of the flow of air, and wherein the method further comprises:

conveying the at least an additional part of the flow of air through the second curved surface, wherein the at least a portion of the planar printing plate along the substantially curved path and wherein said photopolymer or thermal photosensitive coating is heated by the at least an additional part of the flow of air, and is prevented from contacting the second curved surface by the at least the additional part of the flow of air, further comprising arranging the first curved surface and the second curve surface, wherein a gap is formed there between and the substantially curved path is established within the gap, and further comprising arranging the first curved surface and the second curved surface, wherein the gap is smaller when the planar printing plate is not moved along the substantially curved path.

19. A method for heating a planar printing plate, the method comprising:

pressurizing and heating a flow of air, moving the planar printing plate along a substantially curved path, wherein the substantially curved path is adjacent to a first curved surface, the first curved surface comprising:

a plurality of openings, the plurality of openings being operable to convey at least a part of the flow of air, bending the planar printing plate as it is moved along the substantially curved path, and conveying the at least a part of the flow of air through the first curved surface wherein at least a portion of the planar printing plate along the substantially curved path comprises a photopolymer or thermal photosensitive coating, and wherein the coating is heated by the at least a part of the flow of air, and is prevented from contacting the first curved surface by the at least a part of the flow of air, wherein the flow of air comprises an airflow and the method further comprises reducing the airflow before the planar printing plate is moved along the substantially curved path.

* * * * *